US008069927B2

(12) United States Patent
Bachstein et al.

(10) Patent No.: US 8,069,927 B2
(45) Date of Patent: Dec. 6, 2011

(54) REAR-MOUNTED WORK IMPLEMENT CONTROL SYSTEM

(75) Inventors: William Eugene Bachstein, Decatur, IL (US); Daniel Edward Shearer, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 762 days.

(21) Appl. No.: 10/900,349

(22) Filed: Jul. 28, 2004

(65) Prior Publication Data

US 2006/0021770 A1 Feb. 2, 2006

(51) Int. Cl.
*A01B 35/20* (2006.01)

(52) U.S. Cl. ..... 172/431; 74/491; 180/334

(58) Field of Classification Search ..... 172/431, 172/75, 2, 3, 4.5, 781; 74/523, 543, 491, 74/493; 180/334, 335, 336, 333, 402
See application file for complete search history.

(56) References Cited

U.S. PATENT DOCUMENTS

| | | | | | |
|---|---|---|---|---|---|
| 1,822 | A | * | 10/1840 | Kelley et al. | 55/442 |
| 1,831 | A | * | 10/1840 | Kelley et al. | 416/237 |
| 4,216,467 | A | | 8/1980 | Colston | |
| 4,574,651 | A | | 3/1986 | Nordström | |
| 5,160,239 | A | * | 11/1992 | Allen et al. | 414/699 |
| 5,244,066 | A | | 9/1993 | Mackoway et al. | |
| 5,533,590 | A | | 7/1996 | Steffen et al. | |
| 5,584,346 | A | * | 12/1996 | Sakamoto et al. | 172/4.5 |
| 5,685,377 | A | | 11/1997 | Arstein et al. | |
| 5,768,947 | A | | 6/1998 | Fee et al. | |
| 5,911,279 | A | | 6/1999 | Whitener | |
| 6,152,239 | A | * | 11/2000 | Kelley et al. | 172/4.5 |
| 6,276,749 | B1 | * | 8/2001 | Okazawa et al. | 296/190.08 |
| 6,643,577 | B1 | * | 11/2003 | Padgett et al. | 701/50 |
| 6,681,880 | B2 | * | 1/2004 | Bernhardt et al. | 180/315 |
| 6,892,481 | B2 | * | 5/2005 | Yamamoto et al. | 37/348 |
| 6,948,398 | B2 | * | 9/2005 | Dybro | 74/471 XY |
| 6,971,194 | B2 | * | 12/2005 | McClelland et al. | 37/347 |
| 2002/0166267 | A1 | | 11/2002 | McGugan | |

* cited by examiner

*Primary Examiner* — Thomas Will
*Assistant Examiner* — Jamie L McGowan
(74) *Attorney, Agent, or Firm* — Finnegan, Henderson, Farabow, Garrett & Dunner LLP

(57) ABSTRACT

A control system for a rear-mounted work implement on a work machine operable from a forward-facing operator's station located on the work machine is disclosed. The control system includes a surface adjacent to the operator's station, the surface being fixed in a position. A control device is attached to the surface and includes a grip configured to be gripped by an operator. A position of the grip is fixed relative to the surface during use, and the grip is positioned to stabilize an operator when turned in the operator's station to view the work implement. The control device also includes a switching mechanism disposed between the grip and the surface, and being configured to operate the work implement and configured to be actuatable by a hand on the grip.

17 Claims, 3 Drawing Sheets

REAR-MOUNTED WORK IMPLEMENT CONTROL SYSTEM

TECHNICAL FIELD

This disclosure is directed to a rear-mounted work implement on a work machine. More particularly, this disclosure is directed to a control system for a rear-mounted work implement on a work machine.

BACKGROUND

Work machines, such as motor graders, are often equipped with a rear-mounted work implement, such as a ripper device. The ripper device is meant to be controlled while driving the work machine forward. Because of this, the operator must look out of the rear cab window to observe the work implement while he drives. Traditional controllers for the rear-mounted work implement are mounted along a front of the operator's cab and may include a lever having a knob connected to a rod extending from the control panel. The rod typically connects to a mechanical linkage extending from the control panel to the rear of the work machine for operation of the work implement.

During use, the operator may observe the rear-mounted work implement by looking over his shoulder, while at the same time reaching forward with one or both arms to adjust the work implement by operating the control lever. Doing this can be uncomfortable for the operator and, if done for extended periods, can cause fatigue. In addition, while the operator is looking out the back window toward the rear-mounted work implement, any bumps encountered by the motor grader may cause the operator's arm to jog, and may inadvertently move the control lever.

One system for controlling a work implement is disclosed in U.S. Pat. No. 5,768,947 to Fee et al. The '947 patent discloses a work implement hand support for a bulldozer. The hand support extends in a forward direction from a base and end portion. At a distal end of the hand support, a thumb-operated lever is configured to operate the work implement. Although the hand-support is effective and functional, there is a need for a hand-support that can be grasped from the rearward direction to provide additional comfort to an operator.

The control device described herein overcomes one or more of the deficiencies in the prior art.

SUMMARY OF THE INVENTION

A control system is disclosed for a rear-mounted work implement on a work machine operable from a forward-facing operator's station on the work machine. The control system includes a surface adjacent to the operator's station, the surface being fixed in a position. A control device is attached to the surface and includes a grip configured to be gripped by an operator. A position of the grip is fixed relative to the surface during use, and the grip is positioned to stabilize an operator when turned in the operator's station to view the work implement. The control device also includes a switching mechanism disposed between the grip and the surface, and being configured to operate the work implement and configured to be actuatable by a hand on the grip.

In another aspect, a control system is disclosed for a rear-mounted work implement on a work machine operable from a forward-facing operator's station on the work machine. The control system includes a surface adjacent to the operator's station, the surface being fixed in a position. The control system also includes a grip configured to be gripped by an operator. A position of the grip is fixed relative to the surface during use. The grip is disposed adjacent the operator's station and positioned for gripping by an operator when the operator is turned in the operator's station to view the work implement. A switching mechanism disposed between the grip and the surface, and is configured to operate the work implement and configured to be actuatable by an operator's hand on the grip. The grip is configured to stabilize an operator's hand in a substantially constant position during actuation of the switching mechanism.

DETAILED DESCRIPTION

Reference will now be made in detail to exemplary embodiments that are illustrated in the accompanying drawings. Wherever possible, the same reference numbers will be used throughout the drawings to refer to the same or like parts.

Figure 1:
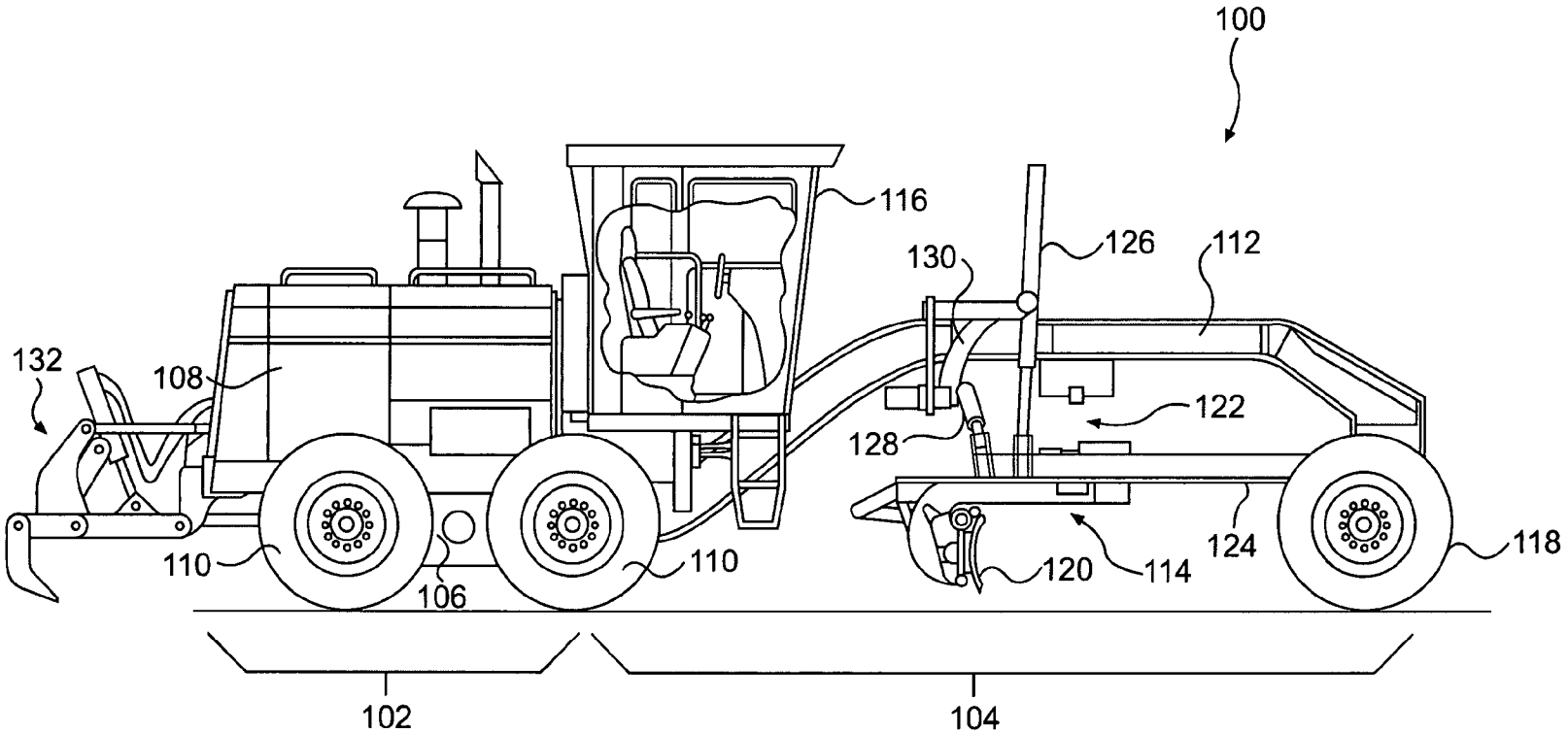
FIG. 1 is a pictorial representation of an exemplary work machine.
Figure 2:
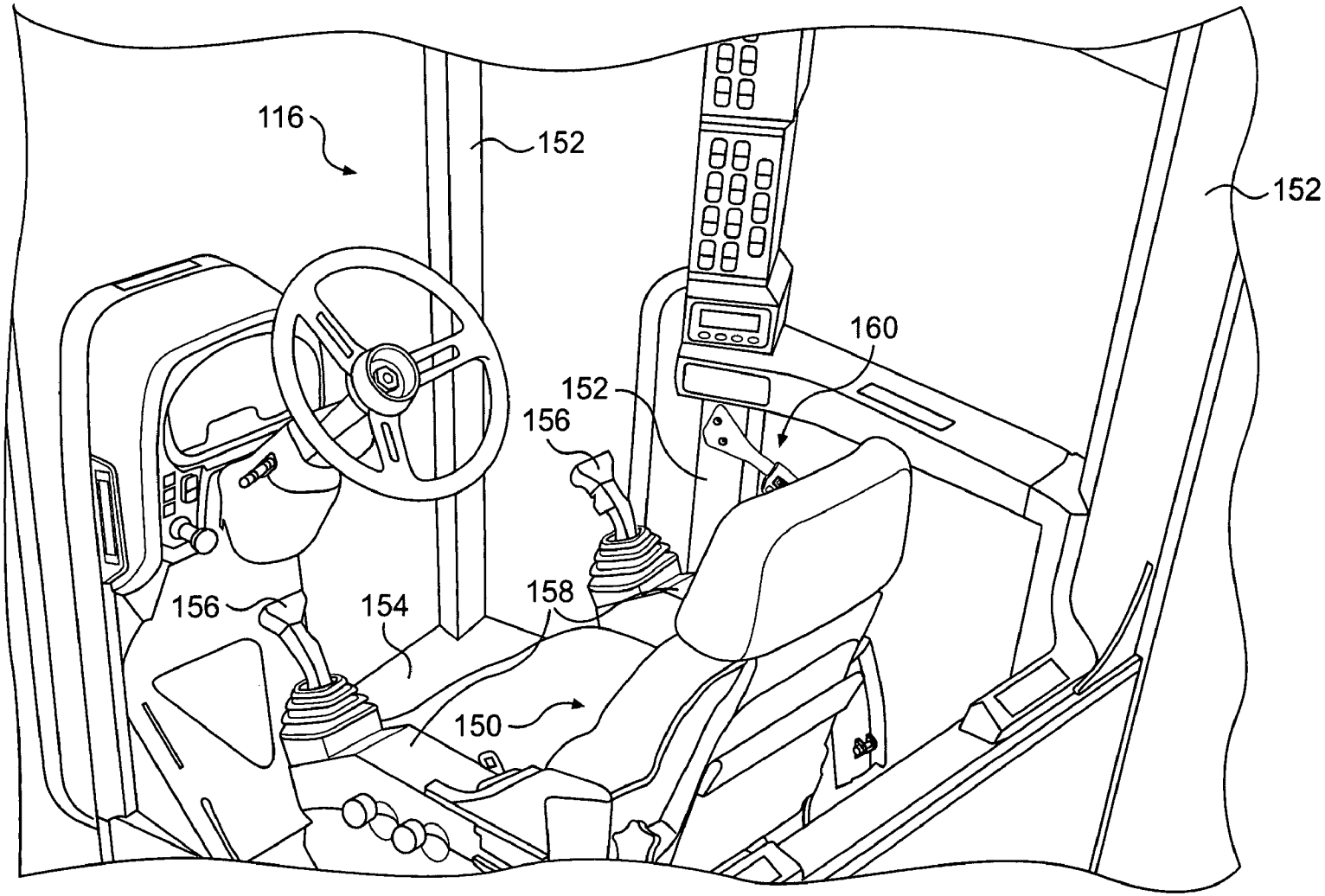
FIG. 2 is a pictorial representation of an interior of an operator's cab.

An exemplary embodiment of a motor grader 100 is illustrated in FIGS. 1 and 2. The motor grader 100 includes a rear frame section 102 and a front frame section 104. The rear frame section 102 includes a rear frame 106 and an engine in an engine compartment 108. The engine in the engine compartment 108 is mounted on the rear frame 106 and drives or powers rear wheels 110 on the motor grader 100.

The front frame section 104 includes a front frame 112, a blade assembly 114, and an operator's cab 116. The front frame 112 extends from front wheels 118 toward the rear wheels 110, and supports the operator's cab 116. The operator's cab 116 contains the many controls necessary to operate the motor grader 100.

The blade assembly 114 includes a blade 120 and a linkage assembly 122 that allows the blade 120 to be moved to a variety of different positions relative to the motor grader 100. The linkage assembly 122 includes a drawbar 124, lift cylinders 126, a center shift cylinder 128, and a coupling 130.

The drawbar 124 is mounted to the front frame 112, and its position is controlled by the lift cylinders 126 and the center shift cylinder 128. The coupling 130 connects the cylinders 126 and 128 to the front frame 112 and can be moved during blade repositioning, but is fixed stationary during earthmoving operations. The height of the blade 120 is controlled primarily with the lift cylinders 126. Additionally, the lift cylinders 126 may be controlled to angle the blade 120 relative to the ground. The center shift cylinder 128 is used primarily to sideshift the drawbar 124 and all the components mounted to the end of the drawbar 124, relative to the front frame 112.

The exemplary motor grader 100 includes a work implement 132 disposed at the rear of the work machine 100. In this exemplary embodiment, the work implement 132 is a ripper device controlled from the operator's cab 116 of the work machine 100. The work implement 132 may be controlled to be raised or lowered relative to the ground in order to dig into the ground at a depth determined by the operator. The work implement may include hydraulic actuators actuatable to raise and lower the device as is known in the art.

FIG. 2 shows one exemplary embodiment of the operator's cab 116 on the motor grader 100 shown in FIG. 1. In this exemplary embodiment, the operator's cab 116 includes an operator's station 150 housed in a supporting structure including vertical support bars 152, a floor 154, and a ceiling (not shown). The operator's station 150 is, in this embodiment, a chair where the operator may sit when operating the motor grader 100. The operator's station 150 may include adjacent controls, such as joystick controllers 156 disposed at the end of adjacent armrests 158. The operator typically sits facing forward when seated in the operator's station 150. Accordingly, to view the work implement 132 at the rear of the motor grader 100, the operator must turn in the operator's station 150 to look out a rear window at the work implement 132.

The vertical support bars 152 extend from the floor 154 to the ceiling of the operator's cab 116 and may form a part of a side or a part of a wall of the operator's cab. In one embodiment, the vertical support bars 152 form a part of a rollover protection structure designed to protect the operator. Additional support bars may extend between and connect the vertical support bars 152, as would be apparent to one skilled in the art.

Adjacent the operator's station 150 is a rear implement control device 160. In the exemplary embodiment shown, the control device 160 is disposed at a location that is adjacent the armrest 158, and extends in a rearward direction in an area between a hand and an elbow of an operator in the operator's station 150. In certain embodiments, the control device 160 may be located within the range of 2 to 6 inches from the armrest 158 and, in addition, may located in close proximity to the joystick 156 at the end of the armrest 158 for easy grasping by the operator. It may also be disposed at a height greater than the height of the armrest 158. However, the control device 160 could also be located in other locations about the operator's cab 116. The control device 160 may be located such that the operator may comfortably grip the control device 160 when turned in his seat to look over his shoulder at the rear-mounted work implement 132.

Figure 3:
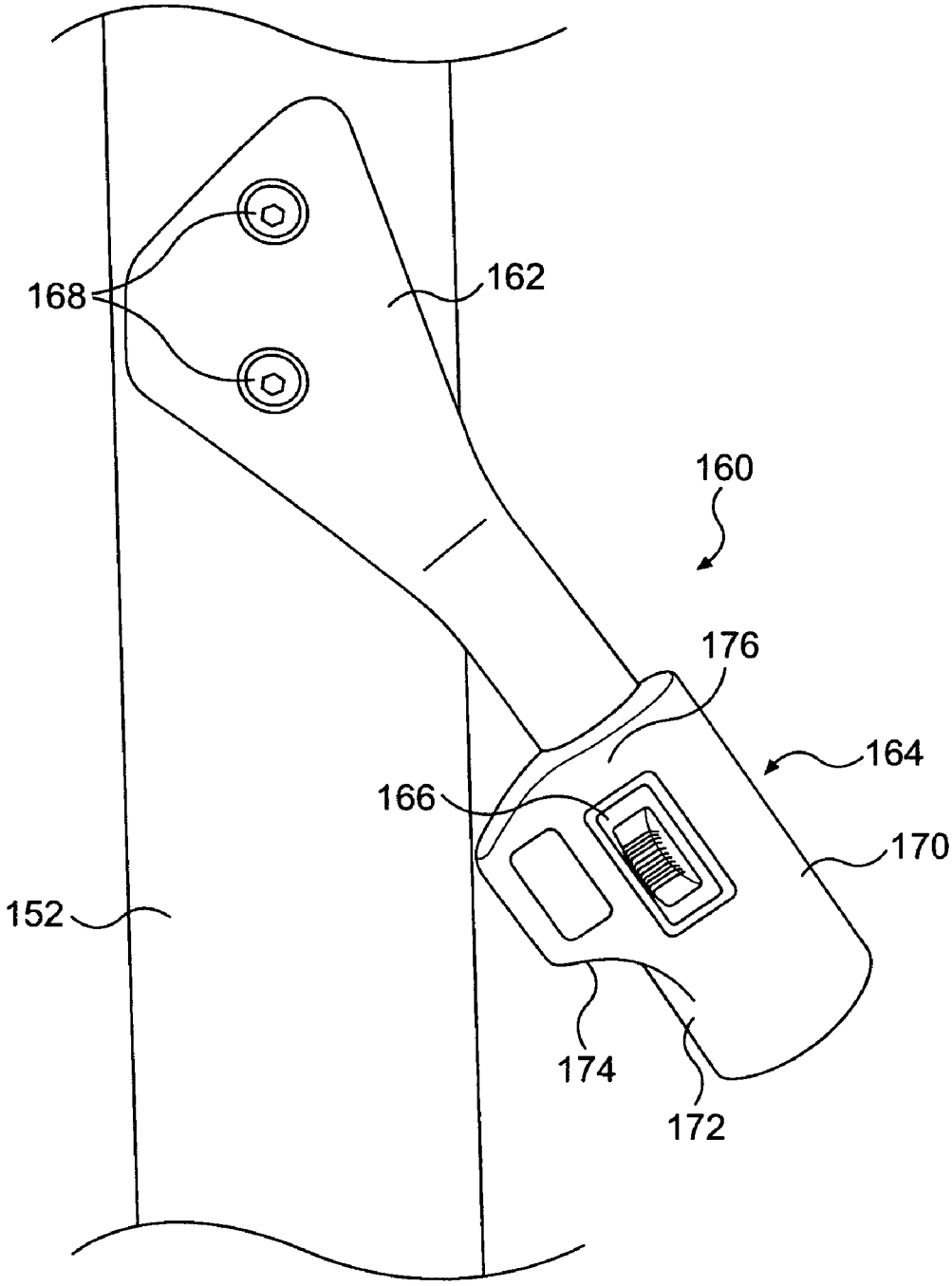
FIG. 3 is a pictorial representation of an exemplary control device for a rear-mounted work implement.

FIG. 3 shows the control device 160 in greater detail. In the exemplary embodiment shown, the control device 160 includes a bracket bar 162, a grip 164, and a switch 166. The control device 160 may be rigidly attached to a vertical surface on the vertical support bar 152 by the bracket bar 162. Therefore, the position of the bracket bar 162 may be substantially immovable relative to the operator's cab 116. In this exemplary embodiment, the bracket bar 162 is a tubular bar having a flattened portion configured to fixedly attach to the vertical support bar 152 by screws or bolts 168. Although the control device 160 is shown being attached to the vertical support bar 152, it should be noted that the control device 160 may be connected to any stable structure in the operator's cab 116. In one exemplary embodiment, the control device 160 is attached to a portion of the operator's station 150.

The grip 164 may extend from the bracket bar 162, and may be rigidly secured to the bracket bar 162 so that the position of the grip 164 is substantially immovable relative to operator's cab 116. In the exemplary embodiment shown, the grip 164 is configured to be used by an operator to stabilize the operator as he turns to look at the rear-mounted work implement 132 and/or to stabilize the operator's hand during operation of the rear-mounted work tool 132.

As referenced herein, "stabilizing the operator" and "to stabilize the operator" mean that the grip 164 is rigidly secured in a location so that the operator may use the grip 164 to balance himself and/or to assist in supporting himself as he turns by allowing him to push or pull against the grip 164 as he turns to look rearward, without displacing the position of the grip relative to the operator's station 150. In addition, as used herein, "stabilizing the operator's hand" and "to stabilize an operator's hand" mean that the operator may place or rest his hand on the grip 164 and, at the same time, operate the rear work implement with the control device without displacing the overall position of the grip relative to the operator's station 150.

As shown in FIG. 3, the grip 164 may include a top portion 170, a bottom portion 172, and a thumb rest 174. The top portion 170 may be configured to support a palm of the operator's hand, and the bottom portion 172 may be configured to be wrapped around by the operator's fingers. The thumb rest 174 may extend from the bottom portion 172 of the grip 164 and may be a place where the thumb may be placed when not in contact with the switch 166 and may be configured to assist an operator in positioning his hand on the grip 164 by touch.

In addition, the grip 164 may include a front portion 176 and a back portion (not shown). The front portion 174 may include the switch 166, while the back portion may be ergonomically formed to include finger recesses configured to individually receive the fingers of the operator's hand.

In the exemplary embodiment shown, the grip 164 is formed of a vinyl material that enables the operator to hold the grip without slipping. However, other materials could be used. For example, in one exemplary embodiment, the grip 164 may include a foam cushion or a pad.

The switch 166 may be located on the front portion 174 of the grip 164 in a position that allows an operator to control the switch 166 with a thumb while holding the grip 164 with his fingers. Accordingly, the switch 166 is disposed between the grip and the bracket bar 162. The switch 166 may be configured to send a signal to an electronic control module (not shown) that may be configured to receive a signal from the switch 166, interpret the signal, and control valves to raise and lower, or otherwise control, the work implement 132.

In the exemplary embodiment shown, the switch 166 is a proportional thumb roller. To raise the work implement 132, the operator may roll or apply pressure in a downward direction on the switch 166. To lower the work implement 132, the operator may roll or apply pressure in an upward direction on the switch 166. Because the switch 166 is proportional, the further the operator rolls the switch 166, the faster the work implement 132 is raised or lowered. Thus, the velocity is proportional to the movement of the switch. In this exemplary embodiment, the switch 166 is configured to return to a center position when it is released. Accordingly, when the operator removes his thumb, the switch 166 returns to a center position and movement of the work implement 132 stops.

Although the switch 166 is disclosed as a thumb roller, other switches could be used. In one exemplary embodiment, the switch 166 is a rocker switch. In another exemplary embodiment, the switch 166 includes at least two buttons, with one button being configured to raise the work implement 132 while the other button is configured to lower the work implement 132. In yet another exemplary embodiment, the switch 166 is a trigger device operable with an index finger. It should also be noted that the switch need not be integrally imbedded in the grip, but may disposed on the bracket bar 162 or other location that can be reached from the grip 164.

In yet another embodiment, the grip 164 is rotatable about a substantially rigid longitudinal axis through the grip, with the overall position of the grip being substantially unchanged relative to the operator's station 150. The switch 166 may be configured to be actuated by rotation of the grip 164 about the axis.

In one exemplary embodiment, the location of the control device 160 is adjustable so that it may be moved from its rigidly fixed position to a new rigidly fixed position that is comfortable to an operator during use. In one exemplary embodiment, the location of the control device 160 is adjusted by removing the bolts 168 to detach the bracket bar 162 from the vertical support bar 152. The control device 160 may be then raised or lowered and reattached to the vertical support bar 152 in the higher or lower location. Other systems for adjustment may be used to allow an operator to selectively alter the position of the control device.

It should be noted that the grip may be formed in shapes other than the exemplary shape shown and described herein. In one exemplary embodiment, the grip 164 constitutes a cylindrical bar rigidly extending from the bracket bar 162. In another exemplary embodiment, the grip 164 is a joystick shape that is rigidly secured so that the grip 164 is immovable relative to the operator's cab 116. Additional shapes and designs apparent to those skilled in the art could also be used.

INDUSTRIAL APPLICABILITY

In use, the work implement 132 may be actuated by an operator seated in the forward-facing operator's station 150. The operator may turn rearward to observe the work implement 132 and may place his hand onto the grip 164. He may orient his hand based on contact with thumb rest 174. Using his arm and hand on the rigidly-secured grip 164, the operator may balance and/or support himself by pushing against or pulling the grip 164 as he turns relative to the grip to look rearward, without displacing the position of the grip relative to the operator's station 150, thereby reducing some of the strain on his neck and back as he turns to observe the work implement 132 for extended periods. Because the grip 164 extends rearwardly, it is comfortable for an operator to hold as he turns in his seat, and easier to grasp.

The grip 164 may also stabilize the operator's hand on the control device 160 in a comfortable position as he operates the rear work implement. Therefore, the operator may place or rest his hand on the grip 164 and, at the same time, operate the rear work implement with the control device, without displacing the overall position of the grip relative to the operator's station 150. This is because the operator may actuate the switch 166 to operate the work implement 132 with his thumb or rotate the grip about its longitudinal axis, while his fingers and hand rest on or hold the grip 164.

Because the control device 160 may be rigidly secured to a stable surface, the control device 160 allows the operator to comfortably control the rear work implement. In addition, because the grip 164 may be rigidly secured in position, and substantially immovable relative to the operator's cab 116, the grip 164 may also provide a stabilizing support for the operator and the operator's hand during operation of the work implement 132. Accordingly, any bumps encountered during driving may be less likely to jog the operator's arm, and therefore, less likely to inadvertently nudge the switch 166 of the control device 160.

It will be apparent to those skilled in the art that various modifications and variations can be made in the disclosed embodiments without departing from the scope of the invention. Other embodiments of the invention will be apparent to those skilled in the art from consideration of the specification and practice of the invention disclosed herein. It is intended that the specification and examples be considered as exemplary only, with a true scope of the invention being indicated by the following claims and their equivalents.

What is claimed is:

1. A control system for a rear-mounted work implement on a work machine operable from a forward-facing operator's station on the work machine, comprising:

a surface adjacent to the operator's station, the surface being fixed in a position; and a control device attached to the surface, including a stationary grip extending rearward from a fixed end of the stationary grip to a free end of the stationary grip and configured to be gripped by an operator, a position of the grip being fixed relative to the surface during use, the grip being positioned to stabilize an operator when turned in the operator's station to view the rear-mounted work implement, wherein the rear-mounted work implement is meant to be controlled while driving the machine forward, and a switching mechanism configured to operate the rear-mounted work implement and configured to be operated by an operator's thumb while gripping the grip.

2. The system of claim 1, wherein the switching mechanism is disposed on the grip.

3. The system of claim 1, wherein the switching mechanism is one of a proportional thumb roller and a rocker switch.

4. The system of claim 1, wherein the surface is a portion of a side adjacent the operator's station.

5. The system of claim 1, wherein the operator's station is a chair having an armrest, the control device being disposed adjacent the armrest.

6. The system of claim 5, wherein the control device is disposed less than about six inches from the armrest and at a height greater than the height of the armrest.

7. The system of claim 1, wherein the grip defines an axis, and the switching mechanism is actuated by rotating the grip about the axis.

8. The system of claim 1, wherein the grip is configured to stabilize an operator's hand during actuation of the switching mechanism.

9. A control system for a rear-mounted work implement on a work machine operable from a forward-facing operator's station on the work machine, comprising:

a surface adjacent to the operator's station, the surface being fixed in a position;

a grip configured to be gripped by an operator, the grip being attached to the surface and disposed adjacent the operator's station, the grip extending rearward from a fixed end of the grip to a free end of the grip and positioned for gripping by an operator when the operator is turned in the operator's station to view the rear-mounted work implement, wherein the rear-mounted work implement is meant to be controlled while driving the machine forward; and a switching mechanism configured to exclusively operate the rear-mounted work implement and configured to be operated by an operator's thumb while gripping the grip, wherein the grip is configured to stabilize an operator's hand in a substantially constant position during actuation of the switching mechanism.

10. The system of claim 9, wherein the switching mechanism is disposed on the grip.

11. The system of claim 9, wherein the switching mechanism is one of a proportional thumb roller and a rocker switch.

12. The system of claim 9, wherein the grip is positioned to stabilize an operator when turned in the operator's station to view the rear-mounted work implement.

13. The system of claim 9, wherein the operator's station is a chair having an armrest, and the control device is disposed less than about six inches from the armrest and at a height greater than the height of the armrest.

14. The motor grader of claim 9, including at least a second control device configured to operate other work implements.

15. A motor grader, comprising:

an operator's cab having a vertical support bar that forms part of a side of the operator's cab, the vertical support bar having a surface adjacent to the operator's cab;

a forward facing chair disposed within the operator's cab;

a ripper disposed on the motor grader rearward of the operator's cab, wherein the ripper is meant to be controlled while driving the machine forward;

a ripper control device configured to solely operate the ripper and disposed on the surface of the operator's cab, including a grip mounted to the vertical support bar forming a portion of the side of the operator's cab, the grip being configured to be gripped by an operator, a position of the grip being fixed relative to the surface during use, the grip being disposed adjacent the chair and extending rearwardly from a fixed end of the grip to a free end of the grip, the grip positioned to stabilize an operator when the operator is turned in the chair to view the ripper; and a switching mechanism disposed between the grip and the surface extending rearwardly from the surface, the switching mechanism being a rocker switch configured to operate the ripper and configured to be actuatable by an operator's hand on the grip, wherein the grip is configured to stabilize an operator's hand in a substantially constant position during actuation of the switching mechanism.

16. The motor grader of claim 15, wherein the switching mechanism is configured to be operated by an operator's thumb while gripping the grip.

17. The motor grader of claim 16, wherein the switching mechanism is disposed in the grip.

* * * * *